United States Patent [19]

Del Signore, II

[11] Patent Number: 4,683,817

[45] Date of Patent: Aug. 4, 1987

[54] DOT MATRIX PRINT HEAD ENERGY CONTROL CIRCUIT

[75] Inventor: James R. Del Signore, II, Trumansburg, N.Y.

[73] Assignee: NCR Corporation, Dayton, Ohio

[21] Appl. No.: 864,986

[22] Filed: May 20, 1986

[51] Int. Cl.[4] ..... B41J 7/92; B41J 9/38

[52] U.S. Cl. ..... 101/93.03; 400/157.3; 400/166; 361/152

[58] Field of Search ..... 400/56, 157.3, 166, 400/124; 101/93.03; 361/152, 154; 307/265, 355, 362

[56] References Cited

U.S. PATENT DOCUMENTS

| | | | |
|---|---|---|---|
| 3,712,212 | 1/1973 | Beery | 101/93 C |
| 3,866,533 | 2/1975 | Gilbert et al. | 101/93.14 |
| 4,027,761 | 6/1977 | Quaif | 197/1 R |
| 4,293,233 | 10/1981 | Hoffman | 400/144.2 |
| 4,293,888 | 10/1981 | McCarty | 400/157.3 X |
| 4,509,494 | 4/1985 | Nishitoba | 307/265 X |

FOREIGN PATENT DOCUMENTS

| | | | |
|---|---|---|---|
| 38277 | 4/1981 | Japan | 400/157.3 |
| 129758 | 8/1982 | Japan | 101/93.03 |
| 128882 | 8/1983 | Japan | 400/157.3 |
| 197063 | 11/1983 | Japan | 400/157.3 |

OTHER PUBLICATIONS

*IBM Tech. Disc. Bulletin,* by J. A. Beavers, vol. 22, No. 3, Aug. 1979, pp. 968–969.

*IBM Tech. Disc. Bulletin,* by L. L. Ackerman, vol. 22, No. 4, Sep. 1979, pp. 1540–1541.

*IBM Tech. Disc. Bulletin,* by W. Greer, vol. 22, No. 8A, Jan. 1980, pp. 3294–3295.

*Primary Examiner*—Paul T. Sewell

*Attorney, Agent, or Firm*—Wilbert Hawk, Jr.; Albert L. Sessler, Jr.; George J. Muckenthaler

[57] ABSTRACT

A dot matrix print head energy control circuit (commonly known as voltage source compensation) utilizes two pulse width modulator circuits (one for receipt printing and one for forms printing). The control circuit also comprises control circuitry and a data latch, the circuitry including RC networks and comparators responsive to outputs of the data latch. A FORMS signal, when inactive and utilizing a source or applied voltage of 24 volts, sets or selects the RC network for receipt printing having an energizing pulse duration of approximately 340 microseconds, and the FORMS signal when active sets or selects the RC network for forms printing having an energizing pulse duration of approximately 380 microseconds. A source or applied voltage of 28 volts sets pulse durations of approximately 300 and 340 microseconds for receipt and forms printing, respectively.

14 Claims, 6 Drawing Figures

DOT MATRIX PRINT HEAD ENERGY CONTROL CIRCUIT

BACKGROUND OF THE INVENTION

In the field of printing, the most common type printer has been the printer which impacts against record media that is caused to be moved past a printing line or line of printing. As is well-known, the impact printing operation depends upon the movement of impact members, such as print hammers or wires or the like, which are typically moved by means of an electromechanical derived system and which system enables precise control of the impact members.

In the field of dot matrix printers, it has been quite common to provide a print head which has included therein a plurality of print wire actuators or solenoids arranged or grouped in a manner to drive the respective print wires a very short, precise distance from a rest or non-printing position to an impact or printing position. The print wires are generally either secured to or engaged by the solenoid plunger or armature which is caused to be moved such precise distance when the solenoid coil is energized and wherein the plunger or armature normally operates against the action of a return spring.

It has also been quite common to provide an arrangement or grouping of such solenoids in a circular configuration to take advantage of reduced space available in the manner of locating the print wires in that specific area between the solenoids and the front tip of the print head adjacent the record media. In this respect, the actuating ends of the print wires are positioned in accordance with the circular arrangement and the operating or working ends of the print wires are closely spaced in vertically-aligned manner adjacent the record media. The availability of narrow or compact actuators permits a narrower or smaller print head to be used and thereby reduces the width of the printer because of the reduced clearance at the ends of the print line. The print head can also be made shorter because the narrow actuators can be placed in side-by-side manner closer to the record media for a given amount of wire curvature.

In the wire matrix printer which is utilized for receipt and journal printing operation, the print head structure may be a multiple element type and horizontally disposed with the wire elements aligned in a vertical line and supported on a print head which is caused to be moved or driven in a horizontal direction for printing in line manner across the receipt or journal paper and wherein the drive elements or transducers may be positioned in a circular configuration with the respective wires leading to the front tip of the print head.

In the wire matrix printer which is utilized for business forms or like record media printing operation, the print head may be oriented in a manner wherein the nose of the print head is pointed downward for printing on the form, slip or like media while the carriage and print head are moved above and across the form or media in the horizontal direction.

In the case of a wire matrix printer which is utilized for form or multi-copy printing, the difference in thickness of the forms or copies may require some means or mechanism for adjusting the gap or the distance between the print head and the printer platen. It must also be appreciated and is well known that in view of variations in equipment and of energizing forces applied thereto, the impact for printing may vary and thereby result in different density images. It is desirable that the energy supplied to each print wire drive element be controlled in an overall arrangement wherein the density of each print image is substantially constant.

Representative documentation in the field of wire matrix print heads used for printing receipts, journals, forms or like record media includes U.S. Pat. No. 3,712,212, issued to J. Beery on Jan. 23, 1973, which discloses apparatus for printing characters with an impact intensity varying in accordance with the surface area of the character being printed. Current through the hammer driving solenoid coil is limited by resistors of different values which are controlled by electrical gates for selectively varying the amount of current supplied to the coil.

U.S. Pat. No. 3,866,533, issued to R. L. Gilbert et al. on Feb. 18, 1975, discloses impression control for an impact printer by changing the width of the pulse applied to the print hammers in accordance with the thickness of the forms being printed and in accordance with the voltage of the hammer energizing source to maintain a constant impact force for uniform print density.

U.S. Pat. No. 4,027,761, issued to R. S. Quaif on June 7, 1977, discloses a matrix print head impact energy control circuit wherein energy supplied to the solenoids is maintained constant notwithstanding variations in the power supply. Supply voltage and a reference voltage are coupled to a summing amplifier which is pulse width modulated to produce a pulsed hammer drive output having constant print energy. A single impact energy control circuit controls all of the print hammers.

U.S. Pat. No. 4,293,888, issued to V. D. McCarty on Oct. 6, 1981, discloses a print hammer drive circuit with compensation for voltage variation wherein the driving current level to a coil is detected and a timing circuit is initiated to control duration of application of maximum current.

SUMMARY OF THE INVENTION

The present invention relates generally to impact type printers which have the capability of printing on record media of different thicknesses. More particularly, the present invention relates to print head energy control means wherein each individual print hammer is energized with a supply voltage of more precise limits and wherein the print head energy control means simultaneously provides modulated pulse width energizing pulses to each and every solenoid or print wire actuator in the print head. The control means is effectively incorporated into circuitry utilized in a manner to compensate for the difference in thickness of several types of record media being used in the printer. The record media may be a single layer sheet or a variety of multilayer forms, any of which may be of different or greater thickness than other media.

The circuitry utilized in the present invention provides voltage source compensation and is arranged as a pair of pulse width modulation circuits to accommodate both receipt printing and forms printing. The impact energy that is required for printing on a receipt, normally a single ply or sheet, is a certain value which is dependent upon the applied voltage, and the impact energy that is required for printing on a slip or form, normally of multiple plies or sheets (or a single ply of greater thickness) is a greater value which is dependent upon the applied voltage. The impact energy for receipt printing is derived from one pulse width and the impact energy for slip or form printing is derived from another or greater pulse width. Selection of the pulse width modulators is under control of a "FORMS" signal, and print head data is entered into a clocked latch from a microprocessor by means of WRITE and DATA signals.

In view of the above discussion, the principal object of the present invention is to provide circuitry in a printer for accommodating different thicknesses of record media.

Another object of the present invention is to provide energy control circuitry which provides compensation for variations in the voltage source.

An additional object of the present invention is to provide circuitry comprising two pulse width modulator circuits for different types of printing.

A further object of the present invention is to provide print head energy control circuitry that compensates for varying source voltages to print images of substantially the same density.

Additional advantages and features of the present invention will become apparent and fully understood from a reading of the following description taken together with the annexed drawing.

DESCRIPTION OF THE PREFERRED EMBODIMENT

Figure 1:
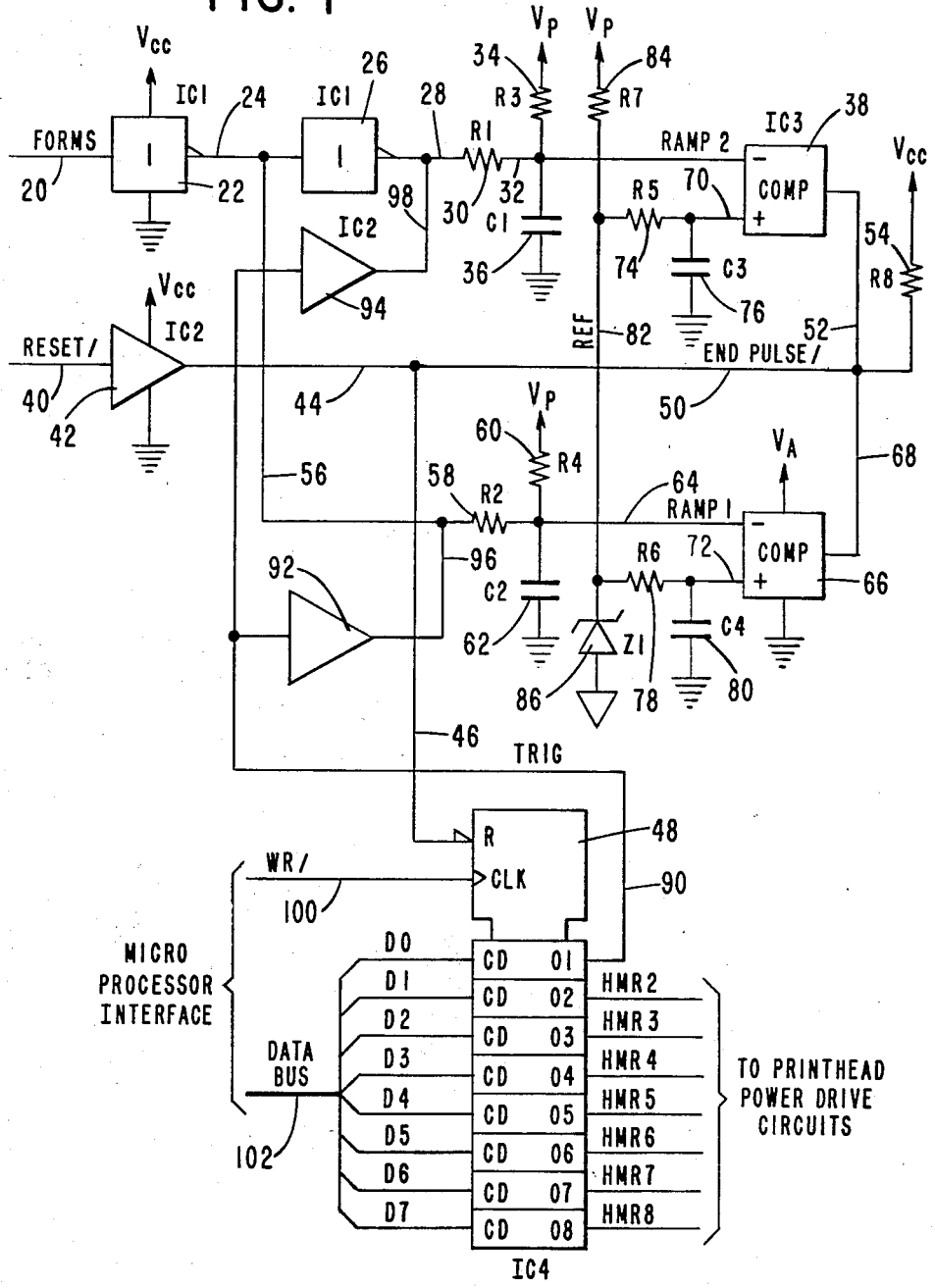
FIG. 1 is a schematic diagram of circuitry incorporating the subject matter of the present invention.

Referring now to FIG. 1, there is shown a schematic diagram of circuitry which is designed to control and electronically provide constant impact energy to each print wire drive element independent or regardless of variations in the supply voltage. This concept is commonly known as "voltage source compensation".

The print head control circuitry is made up of two pulse width modulating circuits, one being for printing of receipts or like record media and the other being for printing on forms or like media. The control circuitry also includes a data latch or like apparatus, and associated power drive circuitry. Either of the pulse width modulation circuits is available to be used in printing operations, and selection of which of the circuits to be utilized is by the FORMS signal under microprocessor control. The entire circuit can be disabled by the RESET/ signal.

Print head data involving information to be printed is latched into a data latch 48 from the microprocessor via WRITE (WR/) and DATA BUS signals and the pulse width modulators are triggered by writing signals simultaneously with the print head data.

A FORMS signal 20 is input to an open collector inverting TTL gate 22, the output 24 thereof being connected as an input to an open collector inverting TTL gate 26. The condition of the FORMS signal 20 controls which of the pulse width modulators is utilized. The output 28 of gate 26 is coupled to a resistor 30 which is connected by lead 32 to an RC network comprised of resistor 34 and capacitor 36, the junction of such RC network being an input (RAMP 2 signal) to a comparator 38. The RC network (resistor 34-capacitor 36) extends between potential source $V_p$ and logic ground. It should be here noted that $V_{CC}$ is +5 volts, $V_A$ is +10.2 volts and $V_P$ is +24 volts, all of such voltages being maintained within plus or minus five percent, and that logic ground (LG) is 0 volts and power ground (PG) is 0 volts.

A RESET/ signal 40 is input to an open collector non-inverting TTL gate 42, the output 44 of which is coupled as an input 46 to the reset terminal of a TTL clocked-latch type apparatus 48. The RESET/ signal resets the clocked latch 48 and also can be used to disable the entire circuit. The output of gate 42 is also coupled by lead 50 to the output 52 of comparator 38 and to a resistor 54, the other end of which is coupled to voltage source $V_{CC}$.

The output 24 of gate 22 is also coupled by lead 56 through a resistor 58 to an RC network comprised of resistor 60 and capacitor 62. The RC network (resistor 60-capacitor 62) extends between potential source $V_p$ and logic ground. The junction of such last-mentioned RC network is connected as an input 64 (RAMP 1 signal) to a comparator 66. The junction of leads 50 and 52 is connected to the output 68 of comparator 66. The RESET/ signal 40 is active low and is wired in OR manner with the outputs of comparators 38 and 66.

The respective inputs 70 and 72 directed to comparators 38 and 66 are coupled to RC networks, one comprising resistor 74 and capacitor 76 and the other comprising resistor 78 and capacitor 80, such networks being connected to lead 82. The lead 82 is coupled through a resistor 84 to a potential source $V_p$ and is also coupled through a zener diode 86 to power ground. The zener diode 86 operates as a precision reference device to power ground.

An output 90 of the latch 48 is connected as an input to an open collector non-inverting TTL gate 92 and also to an open collector non-inverting TTL gate 94. The output 96 of gate 92 is connected to lead 56 and the output 98 of gate 94 is connected to lead 28. The gates 92 and 94 permit the TRIG signal on output 90 to go to either the R4-C2 network or to the R3-C1 network. The output 96 of gate 92 is wired OR with the output 56 of gate 22, and the output 98 of gate 94 is wired OR with the output of gate 26.

The inputs to the data latch 48 are derived through an interface with a microprocessor (not shown) and include a WR/ signal 100 as an input clock signal and a plurality of DATA signals input through a DATA BUS 102. The outputs of the data latch 48 are directed in the form of seven signals or pulses HMR2 to HMR8 as power drives to the print head (not shown). It is noted that the print head utilizing the circuitry of the present invention is a seven wire dot matrix type, whose source voltage is 24 volts and ground reference is power ground (PG).

Figure 2:
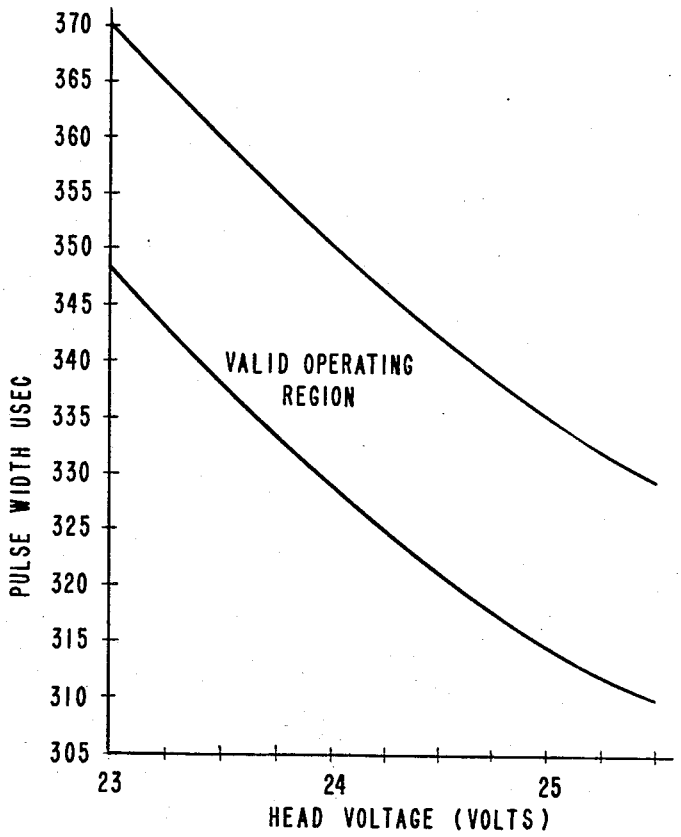
FIG. 2 is a curve illustrating the operating region pulse width for receipt printing when utilizing one source voltage.

FIG. 2 is a print head compensation curve for use in printing of receipts or like record media and illustrates a valid operating region wherein a desirable pulse width of 340 microseconds is compatible with a print head voltage of 24 volts.

Figure 3:
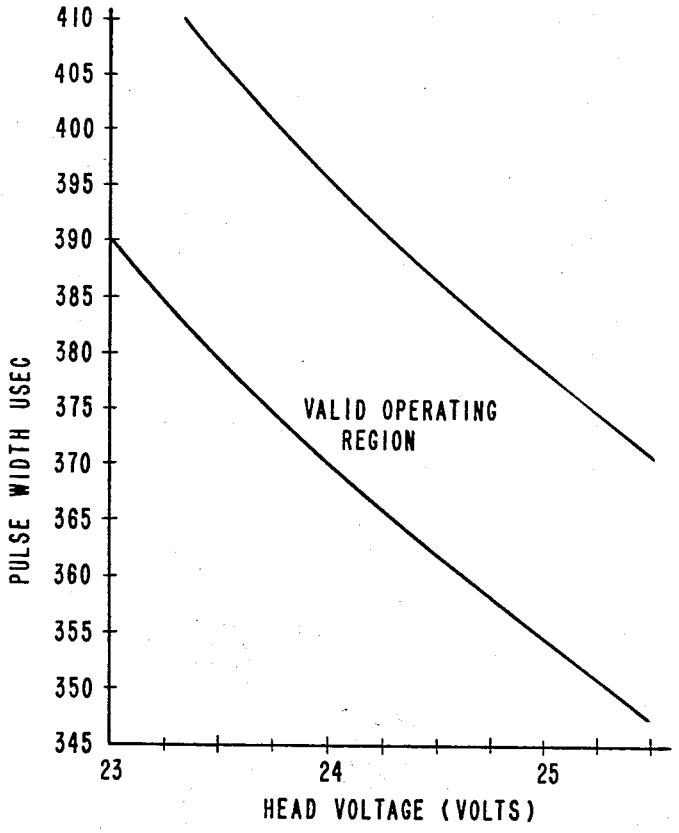
FIG. 3 is a curve illustrating the operating region pulse width for forms printing when utilizing said one source voltage.

FIG. 3 is a print head compensation curve for use in printing of forms or like record media and illustrates a valid operating region wherein a desirable pulse width of 380 microseconds is compatible with a print head voltage of 24 volts.

Figure 4:
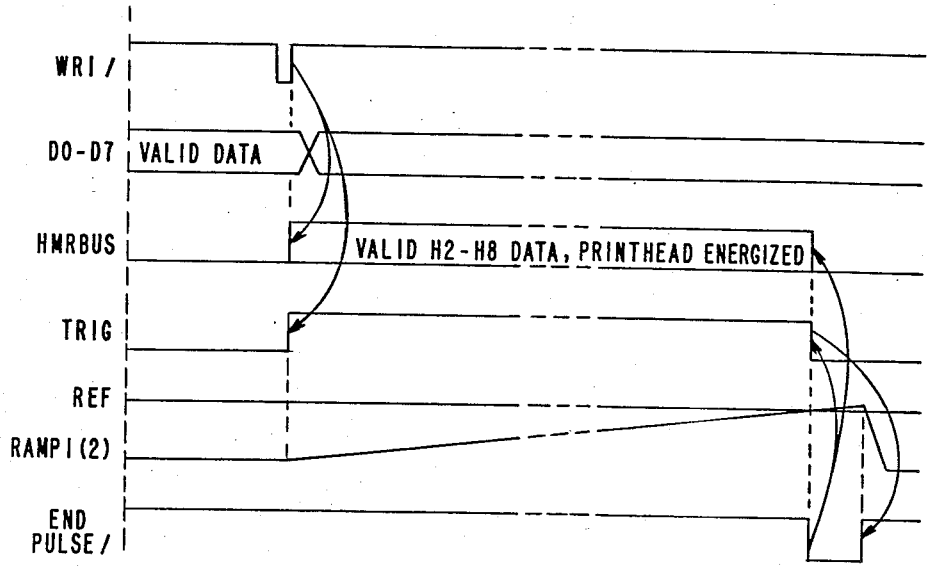
FIG. 4 is an illustration of wave forms utilized in the present invention.

FIG. 4 illustrates a series of wave forms with the WRITE input signal WR/, a plurality of DATA signals D0–D7 of valid data, a HAMMER BUS signal HMRBUS, relating to valid HMR2–HMR8 data signals showing a typical pulse width for printing a line of dots of a seven dot character in the print head energized condition, a TRIGGER signal TRIG which is an output signal of the data latch 48, and an END PULSE/- signal utilized to reset the input of the data latch. A REFERENCE signal REF and a RAMP 1 (2) wave form are illustrated for receipt or form operation.

Some of the devices and elements utilized in the illustrated embodiment of the present invention are further identified as follows: the gates 22 and 6 are Texas Instrument type number 7406, the gates 2, 92 and 94 are Texas Instrument type number 7407, the comparators 38 and 66 are National Semiconductor LM 339, and the latch 48 is Texas Instrument type number 74LS273 which comprises clocked latch means in the form of octal D-type flip flops. The resistors 30 and 58 are carbon composition one-quarter watt, 200 ohms; and the resistors 34 and 60 are metal film, low drift one percent precision, one-quarter watt, resistor 34 being 348K ohms and resistor 60 being 309K ohms.

The resistors 74 and 78 are carbon composition one-quarter watt, 47K ohms; the resistor 4 is a metal film, low drift, one-quarter watt, 8.2K ohms; and the resistor 54 is a carbon composition, one-quarter watt, 4.7K ohms. The capacitors 36 and 62 are polypropylene, one percent precision, 0.0047 microfarads and the capacitors 76 and 80 are ceramic, 0.1 microfarads. The zener diode 86 is a one percent precision type, operating at 5.1 volts as a reference device to power ground.

In the operation of the present invention, the circuit is powered up with the FORMS signal 20 being inactive (OV) which is the proper state for normal printing of receipts. Also during the power up, the RESET/ signal 40 is active (OV), the effect being to reset, or the resetting of, the clocked latch apparatus 48. Under this condition, all outputs 01–08 of latch 48 (HMR2–HMR8 signals) are inactive. The FORMS signal 20, at one or another signal level thereof, provides the means for selecting the desired RC network.

The 01 output signal TRIG of latch 48, on lead 90 through the gates 92, 94, holds the outputs of RC network R3-C1 (resistor 34-capacitor 36) and RC network R4-C2 (resistor 60-capacitor 62), along with the comparators 38 and 66, in an inactive state (OV).

When the print head is to be energized, the WR/ signal 100 turns the circuit on and the 01 output signal TRIG of latch 48 is brought active (+5 V) along with the desired HMR signals. The TRIG signal on lead 90 is directed through gate 92 to the R4-C2 network and RAMP 1 to the comparator 66. Since the output of open collector inverting gate 26 is low because the output of gate 22 is high, the RC network of R3-C1 is kept discharged; however the high logic level FORMS signal is directed by lead 56 through the resistor 58, and C2 charges up through R4 until it reaches the value of the precision zener diode 86. The time of this action requires approximately 340 microseconds when utilizing the selected values. At this point in time, the output of comparator 66 goes inactive and, over leads 68, 50 and 46, resets the outputs of latch 48 to the inactive state, thereby turning off the print head drive circuitry (HMR2–HMR8) and discharging the R4-C2 network by way of R2, thereby setting the state for the next firing sequence.

In the second mode of operation when the FORMS signal 20 is active (+5 V), and therefore the output of the gate 26 is high, the RC network of resistor 34 and capacitor 36 (R3-C1) along with comparator 38 are introduced into the firing sequence to increase the pulse width to 380 microseconds for printing on forms. In this case the FORMS signal goes through gate 26 and resistor 30 and the TRIG signal is directed through gate 94 to the R3-C1 network and RAMP 2 to the comparator 38. The time of this action requires approximately 380 microseconds. During this mode of operation, since the output of gate 22 is low, the R-C network of R4-C2 is kept discharged.

It should be noted that the source voltage for RC networks R3-C1 and R4-C2 is $V_p$ (24 volts). The networks reach $V_z$ (the zener voltage of 5.1 volts) within one RC time constant value, thus making a substantially linear ramp. The slope of this ramp varies linearly with $V_p$ to create the pulse width compensation curves, as illustrated in FIGS. 2 and 3. It is seen that the slope of the ramp is a linear function between voltage and time and that the region of operation covers a print head voltage that is compensated for an amount on either side of 24 volts. If $V_p$ is up or high, the curve of the ramp is steeper or faster and the duration of the pulse is shorter. If $V_p$ is down or low, the slope of the curve is not as steep and the duration of the pulse is longer. It should also be noted that the precision zener diode 86 is referenced to power ground to additionally compensate for significant drops in power ground printed circuit board runs or in cabling runs. The R5-C3 network and the R6 C4 network operate as low pass filters to reduce noise energy to the respective plus inputs of comparators 38 and 66.

A modification of the control circuit of the present invention includes utilization of a source voltage of +28 volts and appearing as $V_p$ on the schematic diagram of FIG. 1. The control circuit for 28 volt operation is identical as described above for 24 volts with the exception that resistor 34 of the R3-C1 network is 365K ohms and resistor 60 of the R4-C2 network is 324K ohms.

Figure 5:
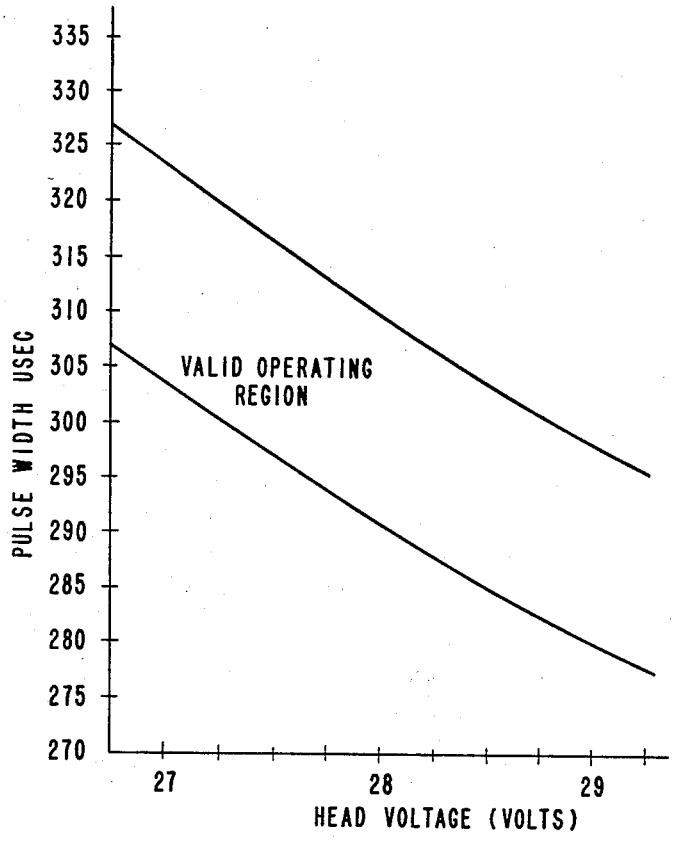
FIG. 5 is a curve illustrating the operating region pulse width for receipt printing when utilizing another source voltage.

FIG. 5 is a print head compensation curve for use in printing of receipts or like record media and illustrates a valid operating region wherein a desirable pulse width of 300 microseconds is compatible with a print head voltage of 28 volts.

Figure 6:
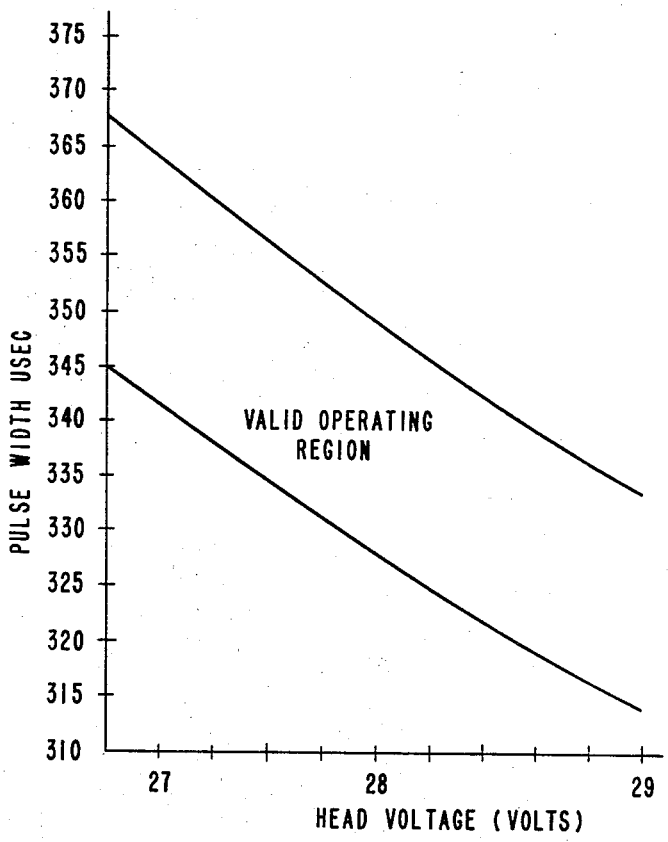
FIG. 6 is a curve illustrating the operating region pulse width for forms printing when utilizing said another source voltage.

FIG. 6 is a print head compensation curve for use in printing of forms or like record media and illustrates a valid operating region wherein a desirable pulse width of 340 microseconds is compatible with a print head voltage of 28 volts.

It is thus seen that herein shown and described is a print hammer energy control circuit that compensates for variations in source voltage and provides pulse width modulation for different types of record media. The circuitry promotes the use of one RC network for receipt printing, another RC network for printing of forms, and the precision reference means to power ground arrangement for compensation of variations in the applied voltage or potential. The circuitry and arrangement enable the accomplishment of the objects and advantages mentioned above, and while a preferred embodiment of the invention has been disclosed herein, variations thereof may occur to those skilled in the art. It is contemplated that all such variations not departing from the spirit and scope of the invention hereof are to be construed in accordance with the following claims.

I claim:

1. A control circuit for a plurality of impact print hammers utilized in printing on record media of one or another type wherein the required printing energy is different for said one and said another type record media, said circuit comprising selection signal means settable to one of two signal levels thereof, latch means for receiving data in accordance with information to be printed and having outputs connected to print hammer drive means, a first RC network coupled to said latch means and responsive to the selection signal means at one level thereof, inverter means coupled to said selection signal means and to said first RC network, first comparator means coupled to said first RC network, a second RC network coupled to said latch means and responsive to the selection signal means at the other level thereof, second comparator means coupled to said second RC network, and precision reference means coupled to said first and to said second comparator means, the first RC network being operated at one level of said selection signal means to provide one pulse width to the latch means for printing of said one type record media by operation of the latch means by the first comparator means when the value of the precision reference means is reached, and the second RC network being operated at another level of said selection signal means to provide another pulse width to the latch means for printing of said another type record media by operation of the latch means by the second comparator means when the value of the precision reference means is reached.

2. The control circuit of claim 1 wherein the inverter means comprises gate means coupled to said selection signal means and to said first comparator means.

3. The control circuit of claim 1 including non-inverting gate means coupled to said latch means and to said second comparator means.

4. The control circuit of claim 1 including filter means coupled to the input of each of said first. and said second comparator means.

5. The control circuit of claim 1 wherein said one pulse width is of approximately 340 microseconds for printing on receipt type record media and said another pulse width is of approximately 380 microseconds for printing on form type record media at an applied voltage of approximately 24 volts.

6. The control circuit of claim 1 wherein the precision reference means comprises a zener diode.

7. The control circuit of claim 1 wherein said one pulse width is of approximately 300 microseconds for printing on receipt type record media and said another pulse width is of approximately 340 microseconds for printing on form type record media at an applied voltage of approximately 28 volts.

8. In a control system for a printer having a plurality of drive elements for impacting on record media of one or another type and each of said types requiring a different printing energy, said system comprising selection signal means settable to inactive and active states thereof, latching apparatus for receiving microprocessor selected data for printing and having outputs connected to print head drive circuits, a first RC network coupled to said latching apparatus and responsive to the selection signal in the inactive state thereof, inverting means coupled to said selection signal means and to said first RC network, a first comparator coupled to said first RC network, a second RC network coupled to said latching apparatus and responsive to the selection signal in the active state thereof, a second comparator coupled to said second RC network, and precision reference means coupled to said first and said second comparators, the first RC network being operated in one state of said selection signal means to provide one pulse width to operate the latching apparatus for printing of one type of record media by operation of the latching apparatus by the first comparator upon reaching the voltage value of the precision reference means, and the second RC network being operated in the other state of said selection signal means to provide another pulse width to operate the latching apparatus for printing of another type of record media by operation of the latching apparatus by the second comparator upon reaching the voltage value of the precision reference means the respective pulse widths being of values to provide substantially constant impact energy regardless of the applied source voltage.

9. In the control system of claim 8 wherein the inverting means comprises open collector inverting gate means coupled to said selection signal means and to said first comparator.

10. In the control system of claim 8, also including open collector non-inverting gate means coupled to said latching apparatus and to said second comparator.

11. In the control system of claim 8 including low pass filter means coupled to the input of each of said first and said second comparators.

12. In the control system of claim 8 wherein said one pulse width is of approximately 340 microseconds for printing on receipt type record media and said another pulse width is of approximately 380 microseconds for printing on form type record media at an applied voltage of approximately 24 volts.

13. In the control system of claim 8 wherein the precision reference means comprises a zener diode.

14. In the control system of claim 8 wherein said one pulse width is of approximately 300 microseconds for printing on receipt type record media and said another pulse width is of approximately 340 microseconds for printing on form type record media at an applied voltage of approximately 28 volts.

* * * * *